United States Patent [19]

Moriyama et al.

[11] Patent Number: 4,523,449

[45] Date of Patent: Jun. 18, 1985

[54] GRIP-FEED MACHINES USED WITH STAMPING AND BENDING MACHINES

[75] Inventors: Yukinori Moriyama; Tsukasa Ozaki, both of Iwakuni, Japan

[73] Assignee: Teijin Seiki Company Limited, Osaka, Japan

[21] Appl. No.: 513,862

[22] Filed: Jul. 14, 1983

[30] Foreign Application Priority Data

Jul. 19, 1982 [JP] Japan ..... 57-110027

[51] Int. Cl.[3] ..... B21D 43/11; B21D 43/13

[52] U.S. Cl. ..... 72/421; 72/422; 72/24; 226/165; 226/158

[58] Field of Search ..... 72/421, 422, 307, 294, 72/24; 226/165, 162, 158–168; 271/267–269, 84, 85; 198/746, 747; 414/750

[56] References Cited

U.S. PATENT DOCUMENTS

| | | | |
|---|---|---|---|
| 3,385,094 | 5/1968 | Brutting | 72/421 |
| 3,658,173 | 4/1972 | Conti | 198/746 |
| 3,757,961 | 9/1973 | Jacobs | 414/750 |
| 4,059,213 | 11/1977 | Toomay | 226/167 |
| 4,203,514 | 5/1980 | Hirai | 414/750 |
| 4,304,347 | 12/1981 | Finzer et al. | 226/162 |
| 4,356,904 | 11/1982 | Siarto | 414/750 |

*Primary Examiner*—Daniel C. Crane

*Attorney, Agent, or Firm*—Cushman, Darby & Cushman

[57] ABSTRACT

A grip-feed machine for gripping a material in the form of strip or the like and feeding the gripped material in a bending machine which has a sun gear, comprising: a guide bracket having a guide shaft securely received therein; a cradle member having lower and upper portions and movable axially forwardly and backwardly on and along the guide shaft and formed at the lower portion thereof with a rack gear in parallel to the guide shaft; a gripping mechanism for gripping the material and feeding the gripped material in the forward and backward directions of the guide shaft; a pinion gear held in mesh with the rack gear of the cradle member; a direct current servomotor for driving the pinion gear to rotate about an axis thereof; an angular position detector having mounted thereon a detecting gear which is held in mesh with the sun gear and adapted for detecting the angular position of the detecting gear to produce a pulse signal indicative of the angular position of the detecting gear; and control mechanism for controlling numerically the direct current servomotor to reliably adjust gripping of the material and feeding of the gripped material in the forward and backward directions on the basis of the pulse signal indicative of the angular position of the detecting gear which is held in mesh with the sun gear.

4 Claims, 28 Drawing Figures

GRIP-FEED MACHINES USED WITH STAMPING AND BENDING MACHINES

FIELD OF THE INVENTION

The present invention relates to a grip-feed machine for gripping a material in the form of strip or the like at a predetermined time and feeding the material by a predetermined length by means of a numeracially control in a bending machine by which the material is formed into a predetermined shape.

SUMMARY OF THE INVENTION

In accordance with the present invention, there is provided a grip-feed machine for gripping a material in the form of strip or the like and feeding the gripped material in a bending machine which has a sun gear, comprising: a guide bracket having a guide shaft securely received therein; a cradle member having lower and upper portions and movable axially forwardly and backwardly on and along the guide shaft and formed at the lower portion thereof with a rack gear in parallel to the guide shaft; a gripping mechanism for gripping the material and feeding the gripped material in the forward and backward directions of the guide shaft; a pinion gear held in mesh with the rack gear of the cradle member; a direct current servomotor for driving the pinion gear to rotate about an axis thereof; an angular position detector having mounted thereon a detecting gear which is held in mesh with the sun gear and adapted for detecting the angular position of the detecting gear to produce a pulse signal indicative of the angular position of the detecting gear; and control means for controlling numerically the direct current servomotor to reliably adjust gripping of the material and feeding of the gripped material in the forward and backward directions on the basis of the pulse signal indicative of the angular position of the detecting gear which is held in mesh with the sun gear.

The gripping mechanism is composed of a movable gripping mechanism and a fixed gripping mechanism. The movable gripping mechanism is adapted to grip the material and feed the material in the forward and backward directions of the guide shaft. The material is gripped at all times by means of either of the movable gripping mechanism and the fixed gripping mechanism.

BRIEF DESCRIPTION OF THE DRAWING

The drawbacks of a prior-art grip-feed machine and the features and advantages of a grip-feed machine according to the present invention will be more clearly understood from the following description taken in conjunction with the accompanying drawings in which.

DESCRIPTION OF THE PRIOR ART

Figure 1:
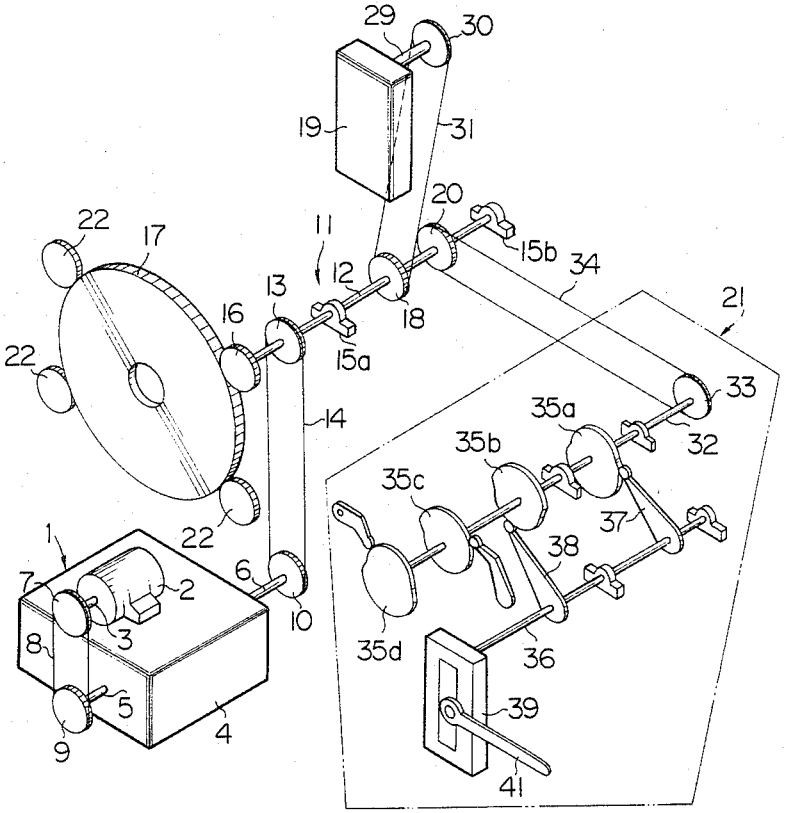
FIG. 1 PRIOR ART
FIG. 1 is a perspective schematic view showing the arrangement between a part of the prior-art grip-feed machine, the sun gear of the bending machine used with the prior-art grip-feed machine, and the stamping machine used with the prior-art grip-feed machine.

A representative example of a conventional grip-feed machine of the nature to which the present invention appertains is shown in FIGS. 1 to 4 of the drawings.

A bending machine used with the prior-art grip-feed machine comprises a power unit 1 including an electric motor 2 having an output shaft 3 and a reduction gear unit 4 having input and output shafts 5 and 6. The electric motor 2 has carried on the output shaft 3 thereof a sprocket 7 which is drivably connected through an endless belt 8 to a sprocket 9 carried on the input shaft 5 of the reduction gear unit 4. The driving force of the input shaft 3 of the electric motor 2 is transmitted to the input shaft 5 of the reduction gear unit 4 through the sprocket 7, the endless belt 8 and the sprocket 9, and then the reduction gear unit 4 reduces rotation of the input shaft 5 thereof in a predetermined rotation and thus transmits the predetermined rotation to the output shaft 6 thereof. The output shaft 6 of the reduction gear unit 4 has a sprocket 10 carried thereon.

The bending machine used with the prior-art grip-feed machine further comprises a drive unit 11 including a drive gear shaft 12 having securely mounted thereon a sprocket 13 which is drivably connected through an endless chain 14 to the sprocket 10 of the power unit 1. The drive gear shaft 12 is rotatably received in bearing 15*a* and 15*b*, and further has securely mounted thereon a drive gear 16 for driving a sun gear 17, a drive sprocket 18 for driving a stamping machine 19 and a drive sprocket 20 for driving a grip-feed mechanism 21 of the prior-art bending machine. The numbers of teeth of the drive gear 16 and the drive sprockets 18 and 20 are equal to one another.

Figure 2:
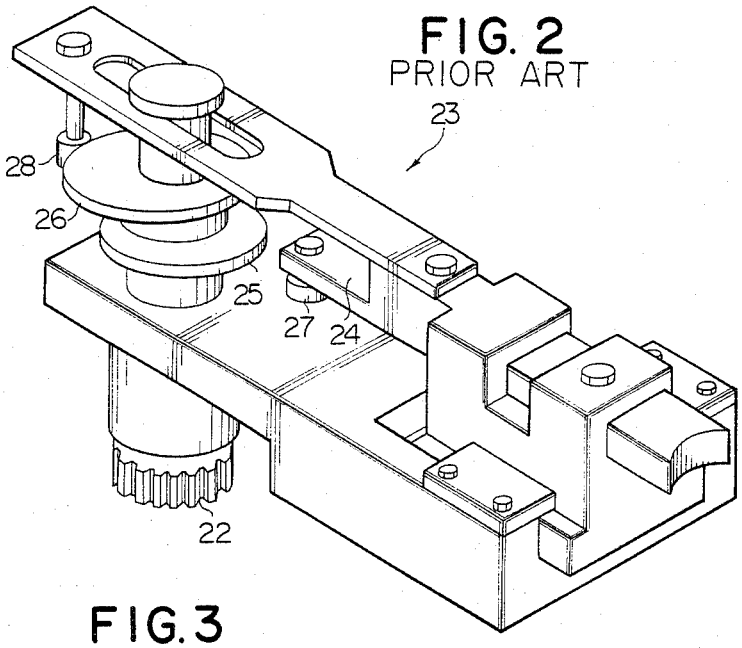
FIG. 2 PRIOR ART
FIG. 2 is an enlarged perspective schematic view showing the construction of a bending mandrel of the bending machine used with the prior-art grip-feed machine.

The sun gear 17 held in mesh with the drive gear 16 is rotatably received in the main body not shown of the bending machine and is further held in mesh with a plurality of pinion gears 22 for driving a slide mechanism 23. The slide mechanism 23 for example shown in FIG. 2 is constituted by a slider 24 for bending a material S in the form of the strip or the like, and a first plate cam 25 for forward reciprocal motion of the slider 24 and a second plate cam 26 for backward reciprocal motion of the slider 24. The plate cams 25 and 26 are securely mounted on a common shaft of the pinion gear 22 held in mesh with the sun gear 17 which is in turn driven to rotate through the drive gear 16 by rotation of the drive gear 12. While, the slider 24 has of its one end a first roller 27 which is urged by means of the first plate cam 25 for forward reciprocal motion of the slider 24 and on its the other end a second roller 28 which is urged by means of the second plate cam 26 for backward reciprocal motion of the slider 24. When the pinion gear 22 is driven to rotate by rotation of the sun gear 17 and thus the gear 22 causes the plate cams 25 and 26 to rotate about the axis thereof, the first roller 27 is urged by the cam 27 for forward reciprocal motion and thereby drives the slider 24 to move forwardly to bend the material S, and thereafter the second roller 28 is urged by the plate cam 26 for backward reciprocal motion and thereby drives the slider 24 to move backwardly to return to an initial position. The slide mechanism 23 thus constructed completes one cycle per one revolution of the pinion gear 22 having the same number of teeth that the drive gear 16 has. As a consequence, the slide mechanism 23 completes one stroke per one revolution of the drive gear 16 securely mounted on the drive gear shaft 12, and accordingly one revolution of the drive gear shaft 12.

Returning back to FIG. 1, the stamping machine 19 used with the conventional grip-feed machine is employed to stamp the material S and includes an input shaft 29 having carried thereon a sprocket 30 which is in turn drivably connected to the drive sprocket 18 securely mounted on the drive gear shaft 12 through an endless chain 31. The numbers of teeth of the sprocket 30 and drive sprocket 18 are equal to each other, so that the stamping machine 19 completes one cycle in a known suitable manner per one revolution of the drive sprocket 18 and accordingly one revolution of the drive gear shaft 12.

The feeding mechanism 21 of the prior-art grip-feed machine comprises a cam shaft 32 having fixedly mounted thereon a sprocket 33 which is in turn drivably connected through an endless chain 34 to the drive sprocket 20 mounted on the drive shaft 12 of the drive unit 11 of the bending machine. The numbers of teeth of the drive sprocket 20 of the gear shaft 12 of the bending machine and the sprocket 33 of the cam shaft 32 of the grip-feed machine are equal to each other so that the gear shaft 12 and the cam shaft 32 are synchronized to each other. The cam shaft 32 has fixedly mounted thereon cams 35*a* and 35*b* for driving a cradle member which will be described hereinafter in a such manner that the drive surfaces of the cams 35*a* and 35*b* are reversed to each other. The cam shaft 32 further has fixedly mounted thereon a cam 35*c* for driving a movable gripping member and a cam 35*d* for driving a fixed gripping member which will described hereinafter, respectively.

The feeding mechanism 21 of the prior-art grip-feed machine further comprises a lever shaft 36 having fixedly mounted on one end thereof levers 37 and 38 which are held in contact with the cams 35*a* and 35*b*, respectively, and on the other end of a crank arm 39. When the cams 35*a* and 35*b* are caused to rotate about their axes by rotation of the cam shaft 32 and then the drive surfaces of the cams 35*a* and 35*b* cause levers 37 and 38 to rotate about the lever shaft 36, the lever shaft 36 is caused to rotate about the axis of the lever shaft 36. As a consequence, rotation of the lever shaft 36 causes the crank arm 39 to rotate about the axis of the shaft 36.

Figure 3:
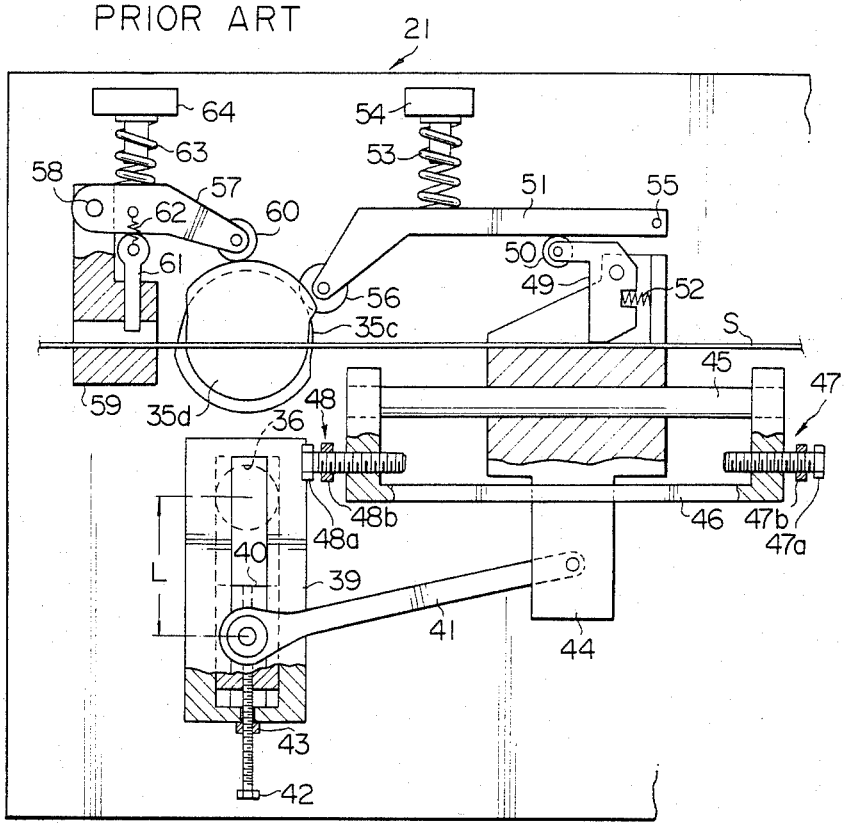
FIG. 3 PRIOR ART
FIG. 3 is a sectional plan view showing the arrangement and construction of the gripping mechanism of the prior-art grip-feed machine.
Figure 4A:
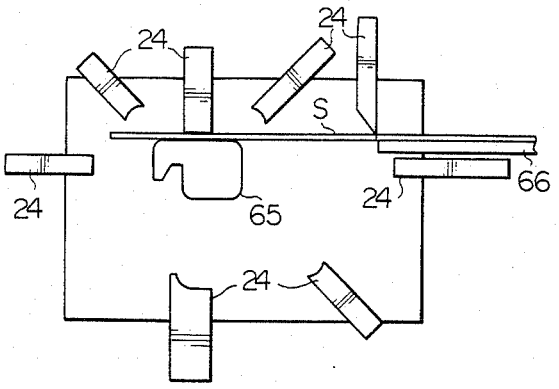
FIG. 4a PRIOR ART
FIGS. 4*a–e* are plan views showing processes of forming the material into a predetermined shape by means of the bending mandrel shown in FIG. 2 with FIG. 4*e* showing the predeterminded shape.
Figure 4B:
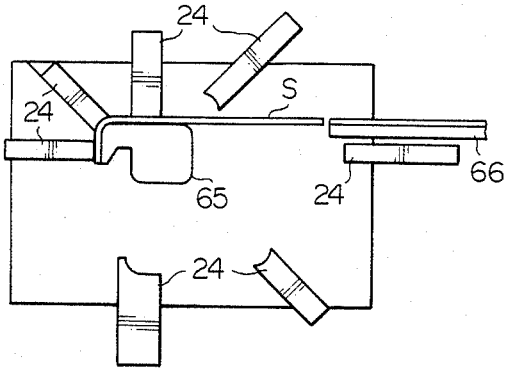
Figure 4C:
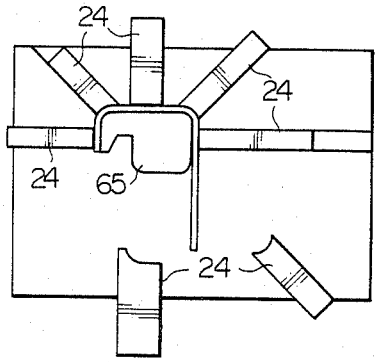
Figure 4D:
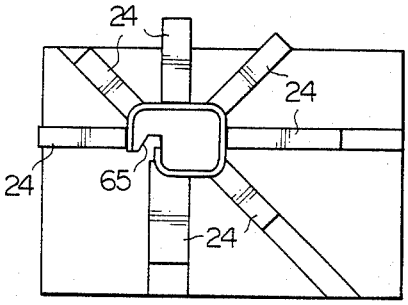
Figure 4E:
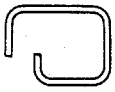

The crank arm 39 fixedly mounted on the lever shaft 36, as shown in FIG. 3, has accommodated therein a slide member 40 which has received therein an elongated bolt 42 projecting outwardly of the crank arm 39. The elongated bolt 42 has received thereon an adjusting nut 43 and further pivotally mounted thereon one end of an actuating lever 41. In this instance, the distance between the center of the lever shaft 36 and the center of the one end of the lever 41 (an eccentric length) is referred to as L hereinafter. The eccentric length L can be adjusted by means of the bolt 42 and the adjusting nut 43. On the other hand, the other end of the lever 41 is also pivotably connected to the cradle member 44 and has a coned disc spring not shown to absorb axial expansion and contraction of movements of the cradle member 44. The cradle member 44 is axially slidably supported by a guide shaft 45 which is fixedly received at opposite ends thereof in a bracket member 46 so as to move on and along the guide shaft 45 in the forward and backward directions of the guide shaft 45 when the pivotal motion of the crank arm 39 is transmitted to the cradle member 44 through the actuating lever 41 intervening between the crank arm 39 and the cradle member 44. The maximum movement of the cradle member 44 is regulated by stop members 47 and 48 provided in the opposite ends of the bracket member 46, so that the coned disc spring is caused to expand or contract and thus absorbs the axial movement of the cradle member 44. The stop members 47 and 48 are constituted by a stop bolt 47*a* and nut 47*b*, and a stop bolt 48*a* and nut 48*b*, respectively. Therefore, large axial movement of the cradle member 44 is determined by the eccentric distance L and small axial movement of the cradle member 44 is adjusted by means of the bolt 47*a* and nut 47*b*, and the bolt 48*a* and nut 48*b*.

The cradle member 44 has pivotably mounted on the upper portion thereof a press member 49 which in turn has rotatably mounted on its one end a roller 50 urged downwardly or in the anticlockwise direction in FIG. 3 by the movable gripping lever 51. The press member 49 further has received in the other end thereof a helical compression spring 52 and is urged upwardly or in the clockwise direction in FIG. 3. On the other hand, the movable gripping lever 51 is urged downwardly in FIG. 3 at its intermediate portion by means of a helical compression spring 53 supported on a spring retainer 54 which is secured to a bracket not shown of the grip-feed machine. The movable gripping lever 51 is further pivotally connected to a pivot pin 55 at its one end and has rotatably mounted on the other end a roller 56 which is held in contact with the cam 35*c* mounted on the cam shaft 32. The movable gripping lever 51 thus constructed is rotatable upwardly and downwardly about the pivot pin 55 by rotation of the cam 35*c*. When the press member 49 is urged downwardly through the movable gripping lever 51 against the helical compression spring 52 by the non-drive surface of the cam 35*c* and the helical compression spring 53, the press member 49 and the cradle member 44 grip the material S therebetween. When, on the other hand, the press member 49 is urged upwardly against the helical compression spring 53 by the drive surface of the cam 35*c* and the helical compression spring 52, the press member 49 and the cradle member 44 ungrip the material S.

The fixed gripping lever 57 of the feeding mechanism 21 is pivotally connected at its one end to a pivot pin 58 mounted on the upper portion of a fixed gripping member 59 and has a roller 60 rotatably mounted on the its other end. The roller 60 is held in contact with the cam 35*d* mounted on the cam shaft 32. The fixed gripping lever 57 further has attached thereto a press member 61 by means of a helical compression spring 62 to cause the press member 61 to move in conjunction therewith. The fixed gripping lever 57 is urged downwardly by means of a helical compression spring 63 which is securely mounted on a spring retainer 64 which is secured to a bracket not shown of the grip-feed machine. The fixed gripping lever 57 thus constructed is rotatable upwardly and downwardly about the pivot pin 58 by rotation of the cam 35*d* mounted on the cam shaft 32. When the press member 61 is urged downwardly through the fixed gripping lever 57 by the helical compression spring 63, the press member 61 and the fixed gripping member 59 grip the material S therebetween. When, on the other hand, the fixed gripping lever 57 are urged upwardly through the roller 60 against the helical compression spring 63 by the drive surface of the cam 35*d*, the press member 61 and the fixed gripping member 59 ungrip the material S. The cams 35*c* and 35*d*, as previously described, are fixedly mounted on the cam shaft 32 in a such manner that the drive surfaces of the cams 35*c* and 35*d* are reversed to each other. Consequently, the material S is gripped at all times by either the press member 49 and the movable gripping lever 51 or the press member 61 and the fixed gripping member 59. When the cradle member 44 is brought into contact with an inner end of the right stop bolt 47*a*, the press member 49 and the cradle member 44 grip the material S therebetween. The material S thus gripped is transferred leftwardly in FIG. 3 toward the left stop member 48 as the cradle member 44 moves on and along the guide member 45 from the right stop member 47 to the left stop member 48. When, thereafter, the cradle member 44 is brought into contact with an inner end of the left stop bolt 48*a*, the press member 62 and the fixed gripping member 59 grip the bland S thus transferred and simultaneously the press member 49 and the cradle member 44 ungrip the material S. Therefore, the feeding length of the material S is determined by movement amount of the cradle member 44 and accordingly the distance between the inner ends of the right and left stop bolts 47*a* and 48*a*. The feeding length of the material S is referred to as M hereinafter. The feeding length M is basically determined by the eccentric length L and the pivotal angle of the crank arm 39. Namely, the maximum movement amount of the cradle member 44 is determined by the eccentric length L and the pivotal angle of the crank arm 39, and the predetermined movement amount of the cradle member 44 and accordingly the feeding length M are determined by adjusting the stop members 47 and 48. Furthermore, the movement amount of the cradle member 44, as previously described, is absorbed by the coned disc spring intervening between the lever 41 and the cradle member 44. Feed of the material S is completed by one revolution of the gear shaft 12 since rotation of the gear shaft 12 and the cam shaft 32 are synchronized to each other. Before the next feed of the material S starts, the material S is stamped and bent by means of the above noted stamping machine 19 and the slide mechanism 23 of the bending machine.

The operation of bending the material S is shown in FIGS. 4(*a*) to 4(*d*). The material S is transferred past a rail 66 to a die 65 by the feeding length M by means of the above described feeding mechanism 21 and subsequently the material S is held and severed by the slider 24 for holding and the slider 24 for severing, respectively. Thereafter, the material S is bent as shown in FIGS. 4(*b*) to 4(*d*) by the slider 24 for bending and thus formed into a predetermined shape as shown in FIG. 4(*e*).

In the prior-art grip-feeding machine thus constructed, the cradle member 44 and accordingly the material S are transferred through the lever 41 intervening between the crank arm 39 and the cradle member 44 upon rotation of the cam shaft 32 and pivotal rotation of the crank arm 39. Furthermore, the cradle member 44 is adjusted to move by means of the stop members 47 and 48 in order to feed the material S precisely. For these reasons, it is necessary to adjust not only the eccentric length L of the crank arm 30 but also the movement length of the cradle member 44 when the feeding length M is varied in length. It is therefore required to use block gages or the like for securing the feeding length M in the accuracy of for example 0.01 mm, resulting in a large amount of wasteful time and labor. In addition, it is difficult to perform two-stage feed of the material S within one cycle of the feeding mechanism 21, viz, one revolution of the gear shaft 12. In particular, it is impossible to make a difference in length between the first and second feeding lengths M since it is required to adjust the eccentric length L of the crank arm 39.

The present invention contemplates elimination of these drawbacks inherent in the conventional grip-feed machine and provision of the improvement of the grip-feed machine.

DESCRIPTION OF THE PREFERRED EMBODIMENT

Figure 5:
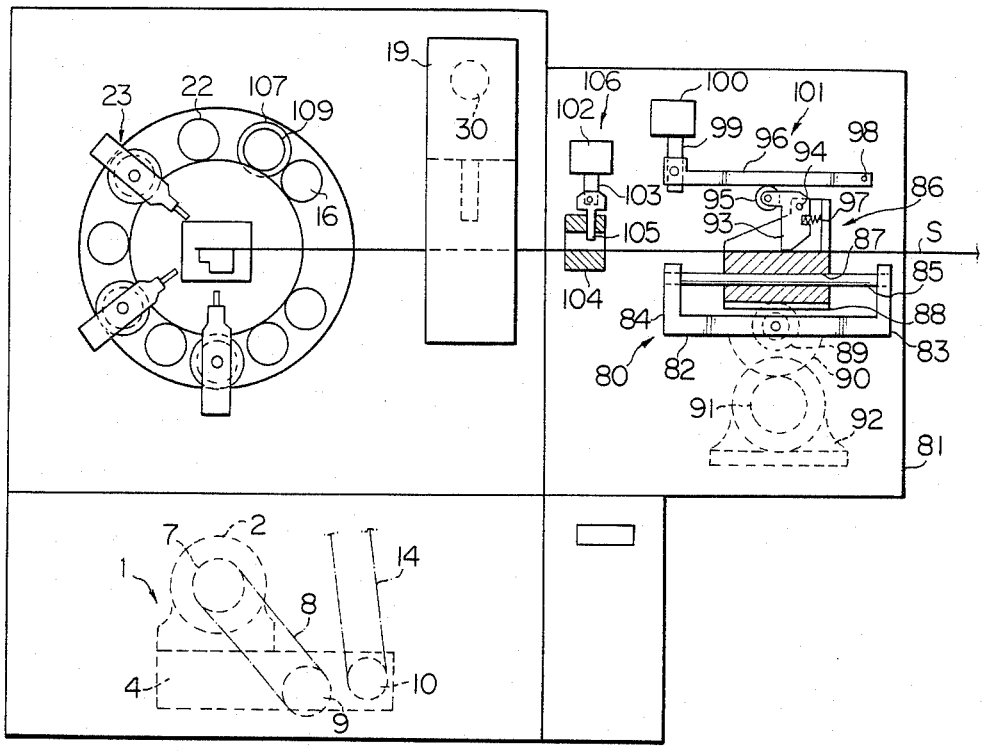
FIG. 5 is a plan view showing the arrangement between the bending machine used with the grip-feed machine according to the present invention, the stamping machine used with the grip-feed machine according to the present invention and the grip-feed machine according to the present invention.
Figure 6:
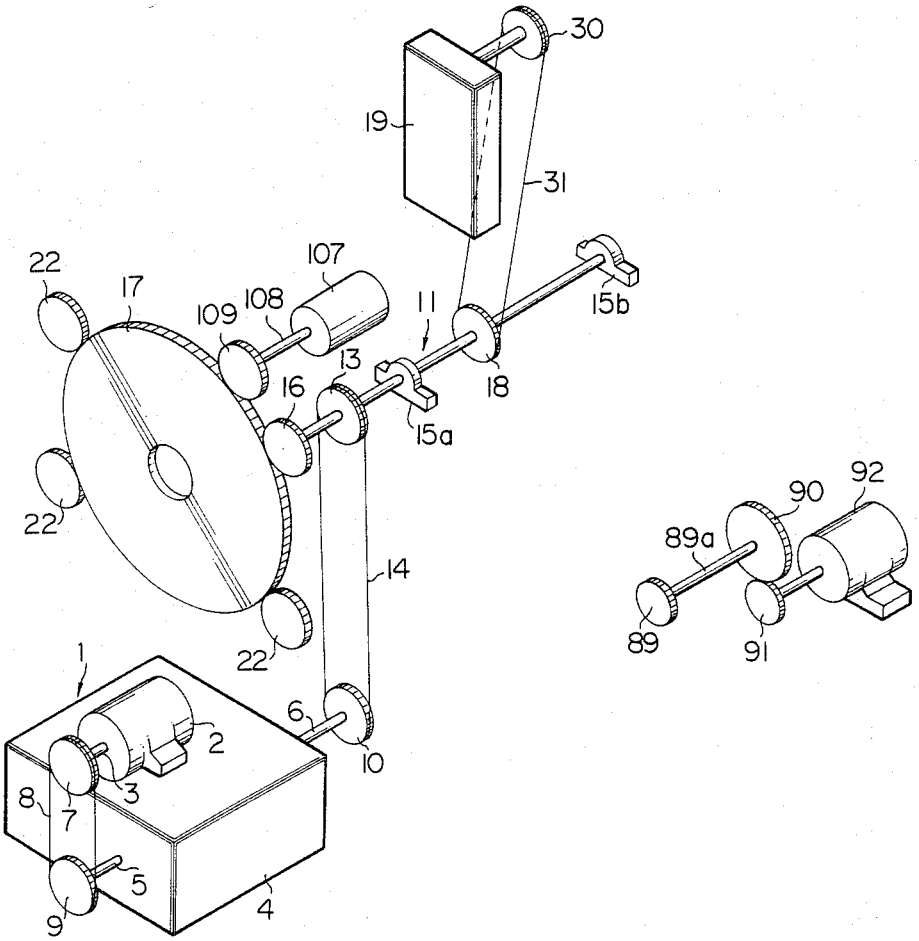
FIG. 6 is a perspective schematic view showing the arrangement of the sun gear and the drive unit of the bending machine and the stamping machine used with the grip-feed machine according to the present invention, and showing a direct current servomotor assembly according to the present invention.

Referring to FIG. 5, a grip-feed machine embodying the present invention comprises a guide bracket 80 securely mounted on the main body 81 thereof and having a generally U-shaped cross section and thus consisting of a base portion 82 and a pair of side portions 83 and 84 projecting perpendicularly from the opposite ends of the base portion 82. The guide bracket 80 has securely received in apertures formed in the side portions 83 and 84 thereof, respectively, a guide shaft 85 in parallel to the base portion 82 thereof. The guide shaft 85 has slidably mounted thereon a cradle member 86 having a base portion for holding a material S in the form of strip or the like and an axial bore 87 through which the guide shaft 85 passes. The cradle member 86 is thus movable axially forwardly and backwardly on and along the guide shaft 85 and is formed at the lower portion thereof with a rack gear 88 in parallel to the guide shaft 85 and held in mesh with a pinion gear 89. The pinion gear 89, as shown in FIG. 6, has a shaft 89*a* projected therefrom and is connected through the shaft 89*a* to a gear 90 which is securely mounted on one end of the shaft 89*a*. The gear 90 is held in mesh with a gear 91 which is securely mounted on a shaft 91*a* projected from a direct current servomotor 92. The pinion gear 89 is thus driven to rotate through the gears 90 and 91 by means of the direct current servomotor 92. When the pinion gear 89 rotates about an axis thereof in the anticlockwise and clockwise directions, the cradle member 86 moves axially forwardly and backwardly on and along the guide shaft 85, respectively. The cradle member 86 further has a first press member 93 pivotally mounted on the upper portion thereof by means of a pivot pin 94. The first press member 93 has a roller 95 rotatably mounted on one end thereof. The roller 95 is brought into rollable contact with a rotatable lever 96. The rotatable lever 96 has one end thereof pivotally mounted through a pivot pin 98 which is securely mounted on a bracket not shown of the grip-feed machine. The rotatable lever 96 further has the other end rotatably mounted on a piston rod 99 which is slidably accommodated in an air cylinder 100 operated by means of an air compressor not shown. A helical compression spring 97 is interposed between the cradle member 86 and the first press member 93 to urge the cradle member 86 to rotate upwardly in FIG. 5 against the rotatable lever 96. The air cylinder 100 drives the piston rod 99 to move upwardly and downwarly in FIG. 5 so that the rotatable lever 96 rotates upwardly and downwardly about the pivot pin 98. When the press member 93 is urged to rotate downwardly about the pivot pin 98 through the rotatable lever 96 against the helical compression spring 97 by means of the piston rod 99 of the air cylinder 100, the press member 93 is caused to rotate downwardly about the pivot pin 94 toward the base portion of the cradle member 86 and thus the first press member 93 and the cradle member 86 grip the material S therebetween. When, on the other hand, the first press member 93 is urged to rotate upwardly about the pivot pin 98 by means of the piston rod 99 of the air cylinder 100, the first press member 93 is caused to rotate upwardly about the pivot pin 94 and thus the first press member 93 and the cradle member 86 ungrip the material S. The above noted first press member 93, the roller 95, the rotatable lever 96, the helical spring 97, the air cylinder 100 and the piston rod 99 of the air cylinder 100 as a whole constitute a movable gripping mechanism 101. An air cylinder 102 is also operated by means of an air compressor not shown and has a piston rod 103 movable toward and away from a fixed gripping base 104 having a base portion for holding the material S. The piston rod 103 of the air cylinder 102 has connected thereto a second press member 105 in such a manner that second press member 105 is movable toward and away from the base portion of the fixed gripping base 104 in conjunction with the piston rod 103. When the air cylinder 102 is actuated to drive the piston rod 103 to move downwardly and upwardly in FIG. 5, the second press member 105 is caused to move downwardly and upwardly, respectively, and thus the second press member 105 and the fixed gripping base 104 grip the material S therebetween and ungrip the material S. The above noted air cylinder 102, the piston rod 103 of the air cylinder 102, the fixed gripping base 104 and the second press member 105 as a whole constitute a fixed gripping mechanism 106. Thus, the movable gripping mechanism 101 and the fixed gripping mechanism 106 compose a gripping mechanism which is adapted for gripping the material S and feeding the material S in the forward and backward directions of the guide shaft 85.

Referring to FIG. 6 of the drawings, a bending machine which is used with the grip-feed machine according to the present invention is shown as comprising a power unit 1 including an electric motor 2 having an output shaft 3 not shown and a reduction gear unit 4 having input and output shafts 5 and 6. The electric motor 2 has carried on the output shaft 3 thereof a sprocket 7 which is drivably connected through an endless belt 8 to a sprocket 9 carried on the input shaft 5 of the reduction gear unit 4. The driving force of the input shaft 3 of the electric motor 2 is transmitted to the input shaft 5 of the reduction gear unit 4 through the sprocket 7, the endless belt 8 and the sprocket 9, and then the reduction gear unit 4 reduces rotation of the input shaft 5 thereof in a predetermined rotation and transmits the predetermined rotation to the output shaft 6 thereof. The output shaft 6 of the reduction gear unit 4 has a sprocket 10 carried thereon. The bending machine further comprises a drive unit 11 including a drive gear shaft 12 having securely mounted thereon a sprocket 13 which is drivably connected through a endless chain 14 to the sprocket 10 of the power unit 1. The drive gear shaft 12 is rotatably received in bearing 15*a* and 15*b*, and further has securely mounted thereon a drive gear 16 for driving a sun gear 17, a driving sprocket 18 for driving a stamping machine 19. The numbers of teeth of the drive gear 16 and the drive sprocket 18 are equal to one another. The sun gear 17 held in mesh with the drive gear 16 is rotatably received in the main body not shown of the bending machine and is further held in mesh with a plurality of pinion gears 22 for driving a slide mechanism 23. The slide mechanism 23, for example, is shown in FIG. 2.

Figure 7:
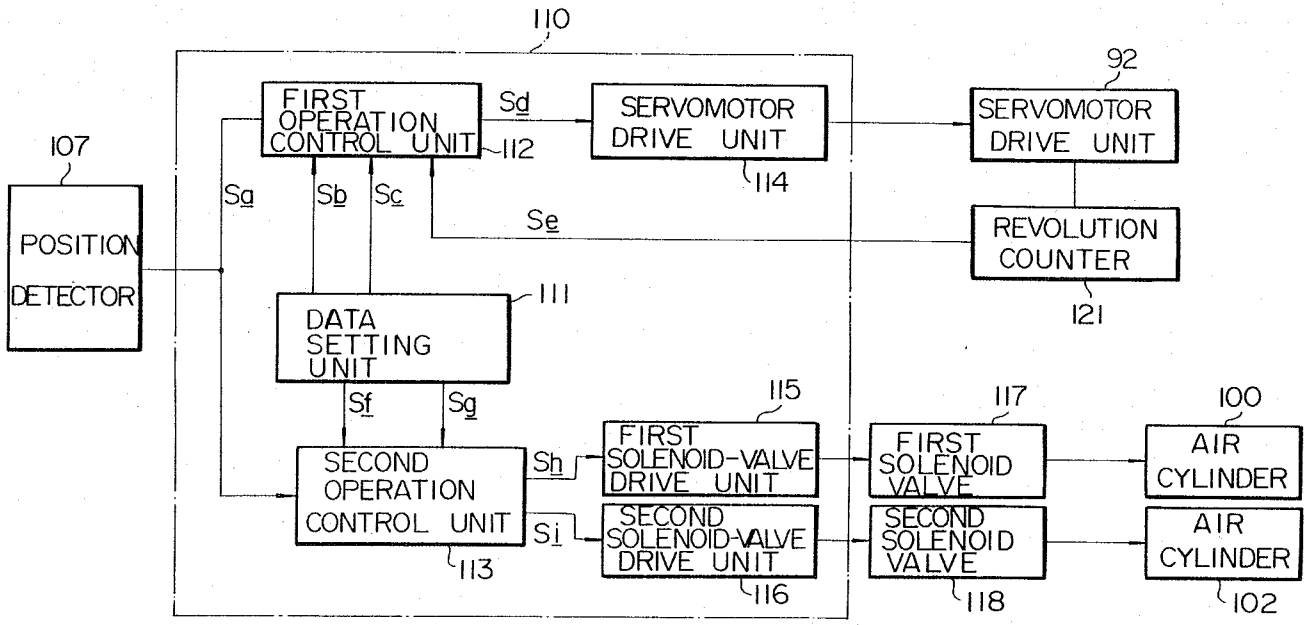
FIG. 7 is a block diagram showing control means for controlling the direct current servomotor according to the present invention.
Figure 8A:
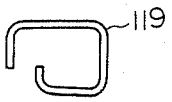
FIGS. 8*a–g* are plan views showing processes of forming a material into a predetermined shape in two-stage feeds according to the present invention with FIG. 8*a* showing the predetermined shape.
Figure 8B:
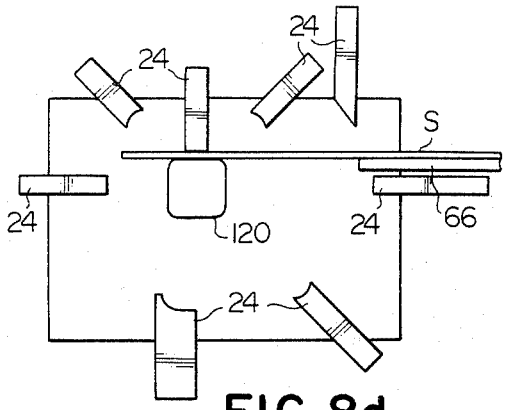
Figure 8C:
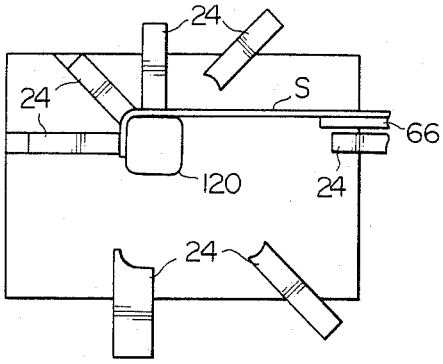
Figure 8D:
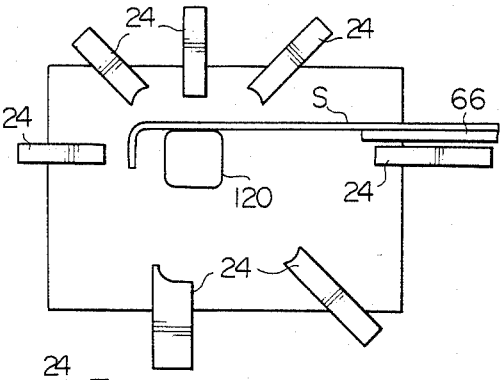
Figure 8E:
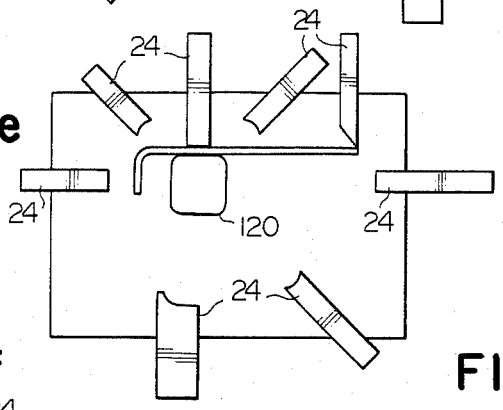
Figure 8F:
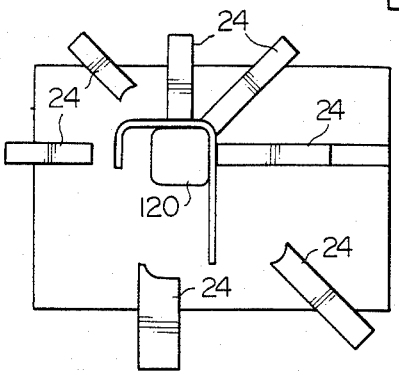
Figure 8G:
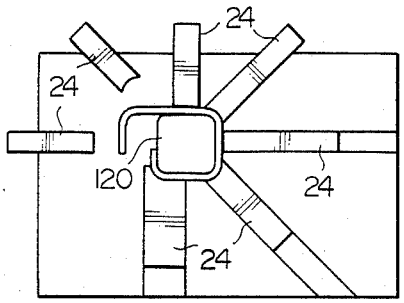
Figure 9A:
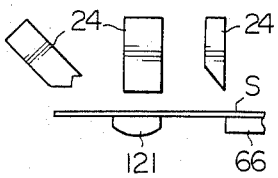
FIGS. 9*a–h* are plan views showing processes of forming a material into a predetermined shape in multi-stage feeds according to the present invention.
Figure 9E:
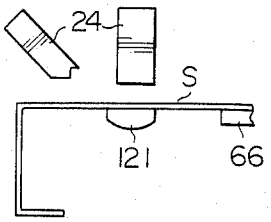
Figure 9I:
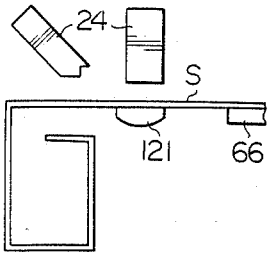
Figure 9B:
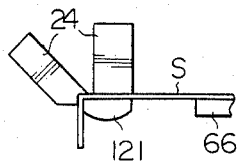
Figure 9F:
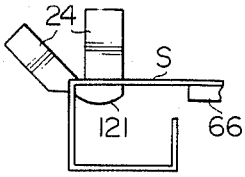
Figure 9J:
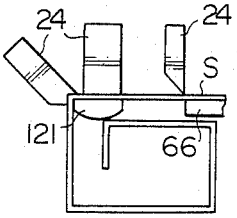
Figure 9C:
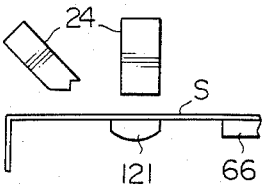
Figure 9G:
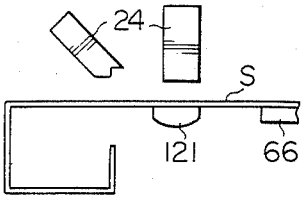
Figure 9D:
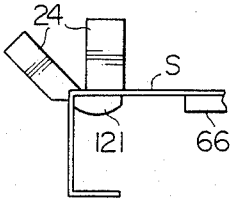
Figure 9H:
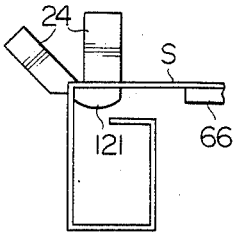

An angular position detector 107 has projected therefrom a shaft 108 which has carried thereon a detecting gear 109 which is held in mesh with the sun gear 17 of the bending machine. The angular position detector 107 is adapted for detecting angular positions of the gear 109. The numbers of teeth of the gear 109 and the drive gear 16 are equal to each other. As a consèquence, the angular positions of the gear 109 is indicative of the angular positions of the drive gear 16, and thus the angular position detector 107 produces a pulse signal Sa indicative of the angular position of the gear 109, that is, the angular position of the drive gear 16. The pulse signal Sa is delivered to control means 110 shown in FIG. 7.

The control means 110 is adapted for controlling drive and non-drive of the above noted direct current servomotor 92, and forward and reverse rotations of the direct current servomotor 92, on the basis of a predetermined feeding length M of the material S, feeding time of the material S and the signal Sa delivered to the control means 110 from the angular position detector 107. The control means 110 further controls operation of the above noted movable gripping mechanism 101 and fixed gripping mechanism 107 and is constituted by a data setting unit 111, first and second operation control units 112 and 113, a servomotor drive unit 114 and first and second solenoid-valve drive units 115 and 116.

The data setting unit 111 consists of feed setting part and grip setting part. The feed setting part of the data setting unit 111 determines numerically setting values of feeding length and feeding time of the material S. These setting values are determined on the basis of the angular positions of the gear shaft 12 since the bending cycle of the Blank S is completed by one revolution of the gear shaft 12. Thus, the data setting unit 111 produces a signal Sb indicative of feeding length of the material S and a signal Sc indicative of feeding time of the material S and delivers the signals Sb and Sc to the first operation control unit 112. When the signal Sa indicative of the angular position of the gear 109 is delivered to the first operation control unit 112 and the signal Sa comes to be equal to the signal Sc indicative of feeding time of the material S, the first operation control unit 112 delivers a first drive signal Sd to the servomotòr drive unit 114. Thereafter, the servomotor drive unit 114 electrifies the direct current servomotor 92 to cause the direct current servomotor 92 to turn on the basis of the drive signal Sd delivered thereto. When the servomotor 92 is caused to turn, the cradle member 86 is caused to move by the length determined on the basis of the combinations of the numbers of revolution of the servomotor 92, the ratio of the numbers of teeth of the gears 90 and 91, the numbers of teeth of the pinion gear 89, and the pitch of the rack gear 88. In this instance, a revolution counter 121 detects the numbers of revolution of the servomotor 92 and delivers to the first operation control unit 112 an input signal Se as a signal of numbers of revolution of the servomotor 92. Thereafter, the first operation control 112 calculates feeding length of the cradle member 86 and accordingly the material S on the basis of the signal Se delivered from the revolution counter 121. When the feeding length thus calculated comes to be equal to the predetermined feeding length of the material S, the first operation control unit 112 ceases delivering the drive signal Sd to the servomotor drive unit 114 and thus the material S is transferred by the predetermined length. While the moving direction of the cradle member 86 is reversed by inverting the drive signal Sd and thereby inverting the direction of the direct current of the servomotor 92. Therefore, the cradle member 86 is caused to reliably move at the predetermined feeding time and forwardly and backwardly to the amount of the predetermined feeding length in accordance with the values of the feeding time and feeding length of the material S previously inserted in the data setting unit 111. In other words, the cradle member 86 is capable of returning to an initial position. In the case that the material S is fed several times within one cycle, the cradle member 86 is caused to move forwardly and backwardly several times by inserting in the data setting unit 111 the respective feeding times and feeding lengthes of the material S. In this instance, it is also possible to make the cradle member 86 return the initial position after the cradle member 86 is moved forwardly to the amount of the total forward length.

On the other hand, the grip setting part of the date setting unit 111 determines numerically setting values of gripping time of the movable gripping mechanism 101 or the fixed gripping mechanism 107. These setting values are determined on the basis of the angular positions of the gear shaft 12 since the bending cycle of the Blank S is completed by one revolution of the gear shaft 12. Thus, the data setting unit 111 produces a signal Sf indicative of gripping time of the movable gripping mechanism 101 and a signal Sg indicative of gripping time of the fixed gripping mechanism 107 and delivers the signal Sf and Sg to the second operation control unit 113.

When the signal Sa indicative of the angular position of the gear 109 is delivered to the second operation control unit 112 and comes to be equal to the signal signal Sf indicative of gripping time of the movable gripping mechanism 101, the second operation control unit 113 delivers a drive signal Sh to the first solenoid-valve drive unit 115. Thereafter, the first solenoid-valve drive unit 115 electrifies a first solenoid valve 117 on the basis of the drive signal Sh delivered thereto. The first solenoid valve 117 intervenes between the air cylinder 100 of the above noted movable gripping mechanism 101 and the air compressor not shown. When the first solenoid valve 117 is electrified by means of the first solenoid-valve drive unit 115, the piston rod 99 of the air compressor 100 is caused to move downwardly to grip the material S. When the first solenoid valve 117 is unelectrified by means of the first solenoid-valve drive unit 115, the piston rod 99 of the air compressor 100 is caused to move upwardly to ungrip the material S.

When, on the other hand, the signal Sa indicative of the angular position of the gear 109 is delivered to the second operation control unit 112 and comes to be equal to the signal signal Sg indicative of gripping time of the fixed gripping mechanism 106, the second operation control unit 113 delivers a drive signal Si to the second solenoid-valve drive unit 116. Thereafter, the second solenoid-valve drive unit 116 electrifies a second solenoid valve 118 on the basis of the drive signal Si delivered thereto. The second solenoid valve 118 intervenes between the air cylinder 102 of the above noted fixed gripping mechanism 106 and the air compressor not shown. When the second solenoid valve 118 is electrified by means of the second solenoid-valve drive unit 116, the piston rod 103 of the air cylinder 102 and accordingly the second press member 105 are caused to move downwardly to grip the material S. When the second solenoid valve 118 is unelectrified by means of the second solenoid-valve drive unit 116, the piston rod 103 of the air cylinder 102 and accordingly the second press member 105 are caused to move upwardly to ungrip the material S.

The material S is ungripped immediately after the material S is gripped by either the movable gripping mechanism 101 or the fixed gripping mechanism 106. In other words, the material S is gripped at all times by either the movable gripping mechanism 101 or the fixed gripping mechanism 106. The material S is gripped by the movable gripping mechanism 101 and is ungripped by the fixed gripping mechanism 106 while the material S is being fed forwardly. The material S is ungripped by the movable gripping mechanism 101 and is gripped by the fixed gripping mechanism 106 while the material S is being fed backwardly.

The operation of the grip-feed machine according to the present invention will be described hereinafter.

It is required to feed the material S two times in case of forming a product shown in FIG. 8(*a*). Firstly, in the data setting unit 111 are inserted the first feeding length and feeding time data of the material S in conformity to the shape of the product to be formed. Further, in the data setting unit 111 are inserted the first gripping time data of the movable gripping mechanism 101 and the fixed gripping mechanism 106 in accordance with the first feeding time data of the material S.

When, now, the signal Sa indicative of the angular position of the gear 109 comes to be equal to the first gripping time data of the movable gripping mechanism 101, the second operation control unit 113 delivers the drive signal Sh to the first solenoid-valve drive unit 115. Thereafter the first solenoid-valve drive unit 115 electrifies the first solenoid valve 117, so that the piston rod 99 of the air compressor 100 is caused to move downwardly to grip the material S. As a consequence, the material S is gripped by the movable gripping mechanism 101 and at the same time the second operation control unit 113 ceases delivering the drive signal Si to the second solenoid-valve drive unit 116. The second solenoid-valve drive unit 116 unelectrifies the second solenoid valve 118, so that the piston rod 103 of the air cylinder 102 and accordingly the second press member 105 are caused to move upwardly to ungrip the material S. Thus, the material S is ungripped by the fixed gripping mechanism 106 immediately after the material S is gripped by the movable gripping mechanism 101.

When, next, the signal Sa indicative of the angular position of the gear 109 comes to be equal to the first feeding time data of the movable gripping mechanism 101, the first operation control unit 112 delivers the drive signal Sd to the servomotor drive unit 114. The servomotor drive unit 114 electrifies the direct current servomotor 92 in the direction of plus on the basis of the drive signal Sd delivered thereto. As a consequence, the cradle member 86 is caused to move toward a die 120 and thus the feed of the material S commences. When the first operation control unit 112 calculates the signal Se delivered from the revolution detector 121 at the first predetermined feeding length, the first operation control unit 112 ceases delivering the drive signal Sd to the servomotor drive unit 114. Thus, the material S is transferred by the first predetermined feeding length.

When the signal Sa indicative of the angular position of the gear 109 comes to be equal to the first gripping time data of the fixed gripping mechanism 106, the second operation control unit 113 delivers the drive signal Si to the second solenoid-valve drive unit 116 and at the same time ceases delivering the drive signal Sh the first solenoid-valve drive unit 115. As a consequence, the fixed gripping mechanism 106 grips the material S and at the same time the movable gripping mechanism 101 ungripps the material S. After the movable gripping mechanism 101 ungripps the material S, the first operation control unit 112 delivers the inverted drive signal Sd to the servomotor drive unit 114 and thus electrifies the servomotor drive unit 114 in the direction of minus. As a consequence, the cradle member 86 is caused to move backwardly toward the initial position. When the first operation control unit 112 calculates the signal Se delivered from the revolution detector 121 at an amount of the initial position, the first operation control unit 112 ceases delivering the inverted drive signal Sd to the servomotor drive unit 114. Thus, the material S is transferred backwardly by the initial position. During the time that the cradle member 86 is moving backwardly toward the initial position, the material S is formed as shown in FIGS. 8(*b*) and 8(*c*).

When the signal Sa indicative of the angular position of the gear 109 comes to be equal to the second gripping time data of the movable gripping mechanism 101, the above described operation is repeated and thus the material S is transferred by the second predetermined feeding length as shown in FIG. 8(*d*). Thereafter, the material S is transferred as shown in FIGS. 8(*e*) to 8(*g*) and the material S is formed into the predetermined product 119. In this instance, the die 120 is simplified as compared with the conventional die 65. Furthermore, a product similar to the produce 119 except length of side is capable of be easily formed by inserting different data of the feeding length in the data setting unit 111. In addition, multi-stage feeds of the material S are easily performed as shown in FIGS. 9(*a*) to 9(*j*). Thus, control means 110 is able to control numerically the direct current servomotor 92 to reliably adjust gripping of said material S and feeding of said material S in the forward and backward directions on the basis of the pulse signal Sa indicative of the angular position of the gear 109.

While it has been described that the angular position detector 107 is adapted for detecting the angular position of the gear 109, such angular position detector may be replaced with a revolution speed detector adapted for detecting the revolution speed of the direct current servomotor 92. In this instance, a signal indicative of the revolution speed of the direct current servomotor 92 is delivered to the above noted servomotor drive unit 114 and thus the speed of the current servomotor 92 may be controlled by Ward-Leonard system.

What is claimed is:

1. A bending and grip-feed machine for gripping material in the form of strip, wire or the like and feeding the gripped material to said bending machine having a sun gear, comprising:

a guide bracket having a guide shaft received therein;

a cradle member movable axially forwardly and backwardly on and along said guide shaft and formed with a rack gear in parallel to said guide shaft;

a movable gripping mechanism cooperating with said cradle member for gripping the material and feeding the gripped material, in conjunction with said cradle member, while said cradle member is moving forwardly on and along said guide shaft;

a fixed gripping mechanism positioned along the path of travel of the material for gipping the material while said cradle member is moving backwardly on and along said guide shaft;

a pinion gear held in mesh with said rack gear of said cradle member;

a direct current servomotor connected to said pinion gear for driving said pinion gear;

control means for controlling numerically said servomotor to adjust movement of said cradle member and operating said movable gripping mechanism and said fixed gripping mechanism to controllably feed the material to the bending machine; and an angular position detector having mounted thereon a detecting gear which is held in mesh with the sun gear of the bending machine for detecting the angular position of said detecting gear to produce a pulse signal indicative of the angular position of said detecting gear, said control means controlling numerically said servomotor to adjust movement of said cradle member and operating said movable gripping mechanism and said fixed gripping mechanism on the basis of said pulse signal.

2. A bending and grip-feed machine as set forth in claim 1, in which said movable gripping mechanism includes a first press member pivotally mounted on said cradle member, a roller rotatably mounted on said first press member, a rotatable lever held in contact with said roller, a compression spring intervening between said cradle member and said first press member, and a first air cylinder having a first piston rod connected with said rotatable lever, and in which said fixed gripping mechanism includes a second air cylinder having a second piston rod, a second press member having one end thereof connected to said second piston rod, and a fixed gripping base with which the other end of said second press member is engageable.

3. A bending and grip-feed machine as set forth in claim 1, in which said control means includes a data setting unit, first and second operation control units, a servomotor drive unit and first and second solenoid-valve drive units, the data setting unit producing a signal indicative of feeding length of the material, a signal indicative of feeding time of the material, a signal indicative of gripping time of said movable gripping mechanism and a signal indicative of gripping time of said fixed gripping mechanism, the first operation control unit delivering a drive signal to said servomotor drive unit on the basis of said pulse signal indicative of the angular position of said detecting gear, said signal indicative of feeding length of the material and said signal indicative of feeding time of the material, the second operation control unit delivering a first drive signal to said first solenoid-valve drive unit on the basis of said pulse signal indicative of the angular position of said detecting gear and said signal indicative of gripping time of said movable gripping mechanism and a second drive signal to said second solenoid-valve drive unit on the basis of said pulse signal indicative of the angular position of said detecting gear which is held in mesh with said sun gear and said signal indicative of gripping time of the fixed gripping mechanism.

4. A bending and grip-feed machine as set forth in claim 3, in which said control means further includes a revolution counter for detecting the numbers of revolution of a servomotor caused to drive by said servomotor drive unit and delivering to said first operation control unit an input signal as a signal of numbers of revolution of said servomotor, said first operation control unit delivering said drive signal to said servomotor drive unit on the basis of said pulse signal indicative of the angular position of said detecting gear, said signal indicative of feeding length of the material, said signal indicative of feeding time of the material and said input signal as a signal of numbers of revolution of said servomotor.

* * * * *